United States Patent [19]

Schultheiss

[11] Patent Number: 4,780,923

[45] Date of Patent: Nov. 1, 1988

[54] INTERPROXIMAL BRUSH DEVICE HAVING HINGED BRUSH RETAINER CAP

[75] Inventor: Peter Schultheiss, North Liberty, Iowa

[73] Assignee: The Gillette Company, Boston, Mass.

[21] Appl. No.: 140,780

[22] Filed: Jan. 19, 1988

Related U.S. Application Data

[63] Continuation-in-part of Ser. No. 125,727, Nov. 30, 1987, abandoned, which is a continuation of Ser. No. 012,186, Feb. 9, 1987, abandoned.

[51] Int. Cl.[4] ..... A46B 3/08; A46B 3/18

[52] U.S. Cl. ..... 15/111; 15/145; 15/167.1; 15/206; 403/397; 433/147

[58] Field of Search ..... 15/111, 145, 167.1, 15/176, 206, 105, 110; 403/347; 128/62 A; 132/89; 433/146, 147; D24/11; D4/105

[56] References Cited

U.S. PATENT DOCUMENTS

| | | | |
|---|---|---|---|
| 70,368 | 10/1867 | Schultz . | |
| D. 262,315 | 12/1981 | Tarrson . | |
| D. 262,316 | 12/1981 | Tarrson . | |
| D. 290,509 | 6/1987 | Alfano | D24/11 |
| 1,173,721 | 2/1916 | Hurvitz . | |
| 1,296,067 | 3/1919 | Fuller . | |
| 3,436,107 | 4/1969 | Karden . | |
| 3,559,226 | 2/1971 | Burns . | |
| 3,892,040 | 7/1975 | Marquis . | |
| 4,030,199 | 6/1977 | Russell . | |
| 4,222,143 | 9/1980 | Tarrson . | |
| 4,296,518 | 10/1981 | Furrier . | |
| 4,319,377 | 3/1982 | Tarrson . | |
| 4,572,223 | 2/1986 | Rosenfeld | 15/167.1 |

FOREIGN PATENT DOCUMENTS

| | | |
|---|---|---|
| 8602532 | 5/1986 | World Int. Prop. O. . |

*Primary Examiner*—Peter Feldman
*Attorney, Agent, or Firm*—John P. Morley

[57] ABSTRACT

An interproximal brush handle including a grip portion and an end portion and a transverse hole for accommodating a stem of an interproximal brush. The brush stem is retained securely in a longitudinal groove on closure of a cap which is pivotally attached to the end portion.

25 Claims, 2 Drawing Sheets

INTERPROXIMAL BRUSH DEVICE HAVING HINGED BRUSH RETAINER CAP

CROSS REFERENCE TO RELATED APPLICATIONS

This Application is a continuation-in-part of U.S. application Ser. No. 125,727 filed Nov. 30, 1987 which in turn is a continuation of U.S. application Ser. No. 012,186 filed Feb. 9, 1987, now both abandoned.

BACKGROUND OF INVENTION

Part 1. The Field of the Invention

This invention relates to interproximal brush devices for oral care. It relates particularly to such a brush device in which a disposable brush insert is retained to a handle by hinged cap retainer means.

Part 2. Description of the Prior Art

Several teeth cleaning aids including various brushes have been developed for performing cleaning for peoples teeth and massaging of gums. The brushes have bristles which rub or wipe perpendicularly across the gum and tooth surfaces. A brush which has been found useful in this manner is a small twisted wire type disposable brush wherein bristles are captured between and extend radially from a pair of twisted metal wires. Accordingly, it is necessary to provide a suitable handle which can hold the small brush insert firmly while in use and hold the twisted wire securely along an extended length thereof. If the brush is to project perpendicularly from the tip of the handle so that it may move sideways to brush into interproximal areas of one's teeth, it becomes difficult to lock the twisted wires securely in place. Unless securely locked, the brush is likely to rotate about the axis of the handle or bend during use. Thus, it is very important to provide a secure grip for the brush in a manner which tends to preclude rotation, bending or bowing of the brush.

Brushes having somewhat similar usage are known. For example, U.S. Pat. No. 4,222,143 to Tarrson et al discloses an interproximal brush handle utilizing a slidable sleeve to retain a brush. U.S. Pat. No. 4,030,199 to Russell discloses a handle for holding a stem mounted disposable brush and utilizes a slidable tapered sleeve for retaining the brush in a friction fit. U.S. Pat. No. 3,559,226 to Burns discloses a toothbrush having a metal handle for holding an interproximal brush, with a holding chuck utilizing screw threads, knurling, or the like to retain the brush. U.S. Pat. No. 4,296,518 to Furrier et al discloses a toothbrush with fixed bristles and a gum massaging accessory which is pivotally attached to the handle. Also, U.S. Pat. No. 4,319,377 to Tarrson et al discloses an interproximal toothbrush which uses a threaded sleeve retainer for the disposable brush.

Another aid which is used for cleaning the general root and interproximal areas of teeth and gums is a toothpick, and the most satisfactory toothpick is usually a wooden one. However, it is usually difficult to work a toothpick between the teeth, especially at the back of the mouth. Therefore, it is desirable to provide a handle for firmly holding a wooden toothpick projecting therefrom at convenient angle thereto.

Although various interproximal type brushes have been developed and proposed, further improvements in such interproximal brushes are still desired, and have been provided by the present invention.

Accordingly, an object of this invention is to provide an improved interproximal brush device which includes a handle having a holding capability at least comparable to a threaded chuck or sleeve. Another object is to provide a pivotally mounted cap section for the brush handle which is easily opened and closed so that a disposable brush may be changed quickly and with little effort. Another object is to provide a brush handle having a toothpick holder which may receive and retain a wooden toothpick without danger from splinters at the broken end. A further object of the invention is to provide an interproximal brush handle which is commercially attractive.

BRIEF DESCRIPTION OF DRAWINGS

The invention will be described further with reference to the following drawings, in which.

BRIEF SUMMARY OF THE INVENTION

Figures 1, 2, 3, 4, 5:
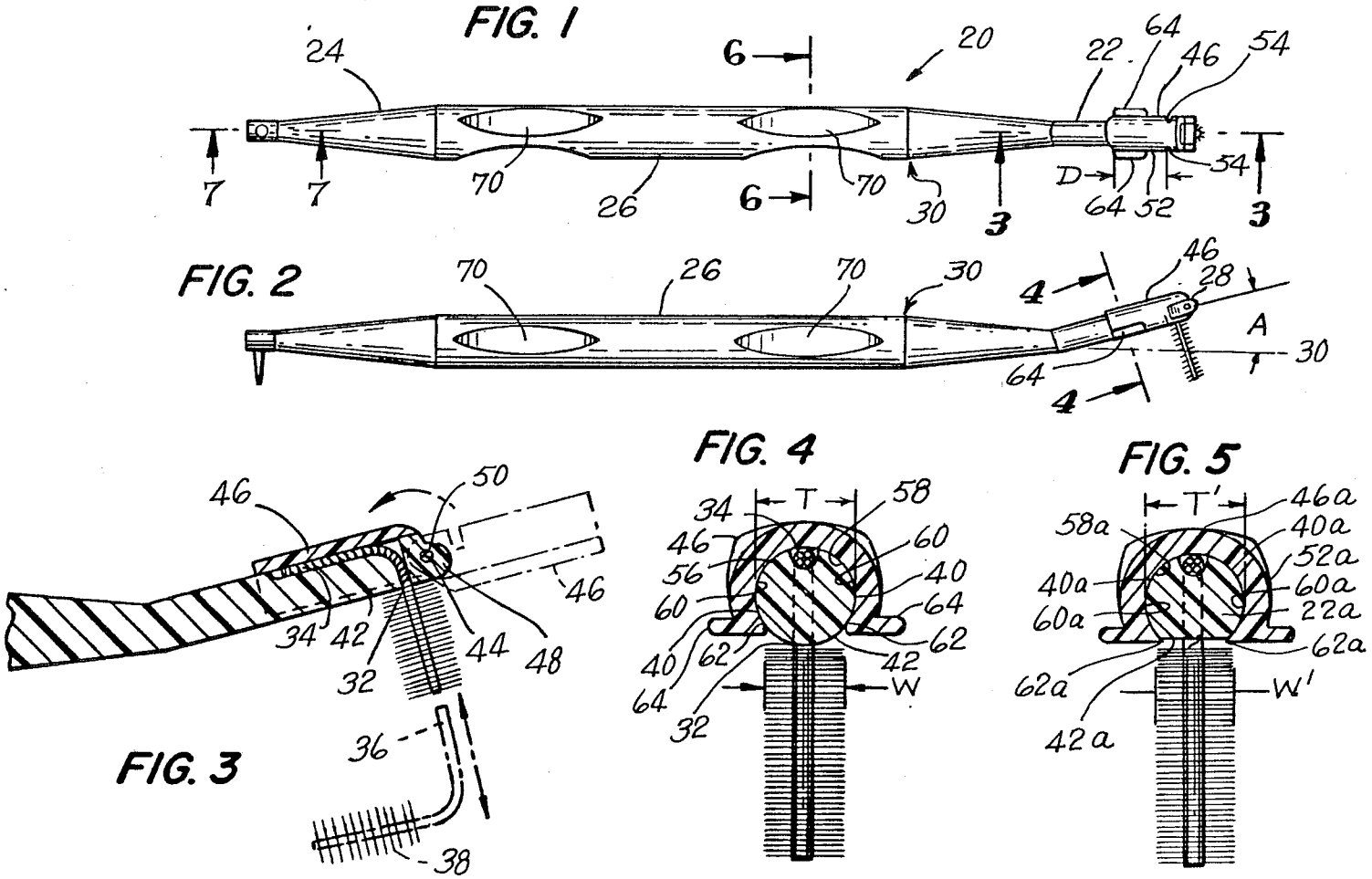
FIG. 1 is a diagrammatic view of the interproximal handle of the present invention.
FIG. 2 is a diagrammatic side view of the brush handle of FIG. 1 after being rotated 90° about its longitudinal axis.
FIG. 3 is a diagrammatic view taken at line 3—3 of FIG. 1 and showing a twisted wire brush attached to the handle by a hinged cap.
FIG. 4 is a diagrammatic sectional view taken at line 4—4 of FIG. 2.
FIG. 5 is a diagrammatic sectional view similar to the view shown in FIG. 4 but showing an alternative embodiment of the invention.

The present invention presents to the art novel, improved interproximal brush handles designed to securely retain an interproximal brush of the type described before. In its broadest form, the novel improved interproximal brush handles include an elongated handle including a grip portion terminating at an end portion which includes a transverse hole arranged for communication with a longitudinal groove. The hole is designed so that the stem of an interproximal brush can be inserted through the hole while the groove is assigned the function of capturing and retaining the length of the stem which is inserted through and extended beyond the hole. A cap is pivotally mounted on the end portion and includes a section adapted and arranged to communicate with and cover at least part of the end portion surface to retain a length of the stem in the groove. The handle further includes means to releasably attach the cap section to the end portion so that worn interproximal brushes can be replaced with new brushes.

In the preferred embodiment of the invention, the groove is carried by the end portion. In such embodiments, the cap section engages the length of the brush stem extending beyond the hole and bends the stem length downwardly as the cap is moved into communication with the end portion. In this way, the cap moves the stem length into the groove and upon attachment of the section to the end portion, the stem length is captured within the groove and securely retained within the groove. In the especially preferred handles of the invention, the cap section includes an opening providing an inner surface having opposed side surfaces terminating at opposed flexible edges. The opposed flexible edges provide an especially effective means for releasably attaching the cap section to the end portion so that the cap section is closed over the end portion with a snap action to securely retain the brush in the handle.

DESCRIPTION OF PREFERRED EMBODIMENTS

Referring to FIGS. 1–4, the interproximal brush handle 20 comprises an elongated member terminating at end portions 22 and 24. Handle 20 includes grip portion 26 which extends between end portion 22 and 24. Preferably, end portion 22 has a reduced thickness (or diameter) and a leading edge 28 (FIG. 2) which preferably is bent upwardly at an angle (A) from about 5° to about 25° with respect to the longitudinal axis 30 of handle 20. In the illustrated handles of FIGS. 1–4, leading edge 28 is bent upwardly at an angle of about 15°. A transverse hole 32 (FIGS. 3 and 4) extends through the leading edge region of end portion 22 with the axis of hole 32 being included in angle A. Connected to hole 32 is a longitudinal groove 34 which extends rearwardly from hole 32.

The diameter of hole 32 is selected to permit stem 36 of interproximal brush 38 (FIG. 3) to be easily inserted through hole 32 but also to restrain movement or twisting of stem 36 to any significant extent when stem 36 is positioned within hole 32. Interproximal brushes are well known articles of commerce and essentially comprise a brush having bristles extending radially from the stem which usually involves a pair of twisted wires. Interproximal brushes can take many shapes to serve interproximal and root brushing needs. For example, the brush may be conical (FIG. 3) or cylindrical (FIG. 4) in shape. Additionally, the stiffness of the bristles can vary from degrees of softness to degrees of hardness and the bristles may be natural or synthetic fibers with nylon fibers being preferred. Any of the several different types of interproximal brushes can be used in the handles of the present invention. Further details relating to interproximal brushes can be found in U.S. Pat. No. 4,395,943.

Longitudinal groove 34 is designed to provide a locking groove for capturing and retaining a length of stem 36 in a fixed position on end portion 22. Accordingly, groove 34 is wide and deep enough to receive stem 36 and long enough to receive a fairly precise length of stem 36, which will ensure that brush 38 projects a predetermined distance beyond the other side of end portion 22 when stem 36 is bent downwardly and pressed into groove 34.

In the preferred interproximal brushes of the invention, end portion 22 has a curved (cylindrical or partially cylindrical) cross-sectional shape (FIGS. 3 and 4) and opposed side surfaces 40, and bottom surface 42. As best seen in FIG. 3, dual projections 44 are provided near leading edge 30 and located in alignment with each other on opposed side surfaces 40. A molded polymeric cap 46 having opposed ears 48 (FIG. 3) which include holes 50 arranged and sized to accommodate projections 44 is pivotally mounted on end portion 22. Cap 46 includes section 52 which is separated from ears 48 by slots 54 and extends rearwardly from slots 54 for a distance designated as D (FIG. 1). As best shown in FIG. 4, section 52 provides an opening 56 which has an inner surface 58 closely conforming to the cross-sectional shape and size of end portion 22. Inner surface 58 includes opposed side surfaces 60 terminating at opposed side edges 62. Preferably edges 62 extend downwardly at least to the center of end portion 24.

In the especially preferred embodiments of the present invention, opposed side edges 62 are flexible and are spaced apart from each other by a dimension (W, FIG. 4). Dimension W is selected so that flexible edges 62 will flex outwardly when at least a portion of edges 62 engage opposed end portion side surfaces 40 at the maximum thickness (T, FIG. 4) of end portion 22. As shown in FIG. 4, the thickness of end portion 22 decreases toward bottom surface 42. Accordingly as edges 62 are pushed beyond maximum thickness T and toward bottom surface 42, flexed edges 62 relax inwardly to approach or restore dimension W between edges 62. Flexible edges 62 therefore provide an extremely effective but simple means for releasable attachment of section 52 to end portion 24. Flexible edges 62 permit section 52 to be snapped over end portion 24 and also permit section 52 to be disengaged from end portion 24 by lifting cap 46 upwardly to again flex edges 62 outwardly as edges 62 approach and reach T. The disengagement of section 52 from end portion 24 can be facilitated by projections 64 (FIGS. 1 and 4) which can be easily lifted or pressed upwardly by a finger nail.

FIG. 5 illustrates another especially preferred but alternative handle of the present invention. As shown in FIG. 5, cap **46*a* includes section 52*a* which provides an opening having an inner surface 58*a* closely conforming to the cross-sectional shape and size of end portion 22*a*. Like the handle shown in FIGS. 1–4, inner surface 58*a* includes opposed side surfaces 60*a* terminating at flexible opposed side edges 62*a*. Additionally, edges 62*a* are spaced apart by dimension W' which permits edges 62*a* to flex outwardly on communication with opposed end portion side surfaces 40*a* having a maximum thickness T' which exceeds dimension W'. As shown, end portion 22*a* has a partially cylindrical cross-sectional shape and a substantially flat bottom surface 42*a* and the thickness of opposed end portion side surfaces 40*a* at or approaching bottom surface 42*a* is less than W. Accordingly, as section 52*a* is rotated downwardly toward end portion 22*a* for engagement, edges 62*a* are flexed outwardly when in communication with opposed end portion side surfaces 40*a* having a thickness greater than W' but relax and flex inwardly as edges 62*a* approach and reach bottom surface 42*a*. In the especially preferred embodiment of the invention (FIGS. 1–5), the cooperation between the opposed flexible side edges and the cross-sectional dimensions of opposed end portion side surfaces provides means for releasably attaching sections 52 and 52*a* to the end portions 22 and 22*a*** which achieves an extremely desirable and effective snap-action effect.

In using brush handles of the present invention, the user has two options for locking stem 36 of brush 38 into groove 34. First, the user may bend stem 36 as seen in FIG. 3 with section 52 in the disengaged position to form a substantially right angle bend between stem 36 and brush 38. Stem 36 is then inserted through hole 32 and into groove 34 and cap 46 is rotated downwardly to snap section 52 about end portion 22 as shown in FIG. 3. In the preferred option, stem 36 is inserted through hole 32 and brush 38 is held against end portion bottom surface 42 with a finger while cap 46 is rotated downwardly for engagement of section 52 with end portion 22. During the downward movement, section 52 simultaneously bends and guides stem 36 into groove 34. The snap action effect discussed before and provided by flexible edges 62 of section 52 assures effective bending and guidance of stem 36 into groove 34. Additionally, the use of transparent or translucent polymeric cap materials permits the user to observe the guidance of stem 36 into groove 34 and make appropriate adjustments in the alignment between stem 36 and groove 34.

In the embodiments of the invention shown in FIGS. 1–5, handle 20 and cap 46 are formed by high volume injection molding techniques and may be fabricated of any suitable moldable polymeric material such as polypropylene. Assembly of the two molded parts may be done manually or by machine by flexing ears 48 so that holes 50 can engage projections 44 to pivotally attach cap 46 to end portion 22. In a representative preferred embodiment of the invention, hole 32 had a diameter of 0.055 inches while groove 34 had width and depth of 0.05 inches and a length of 0.5 inches. The dimension (W', FIG. 5) between opposed flexible side edges **62*a* was 0.172 inches while the maximum thickness (T', FIG. 5) was 0.198 inches. A brush used with the handle had a stem 36** having a substantially uniform diameter of about 0.05 inches and a stem length of about 0.5 inches.

Figure 6:
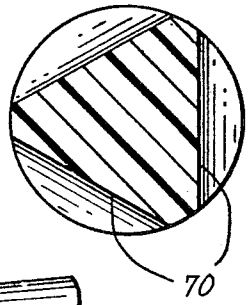
FIG. 6 is a diagrammatic sectional view of the handle taken at line 6—6 of FIG. 1.

Grip portion 26 of handle 20 may be flat, angular or circular in shape. Grip portion 26 may be provided with grip facilitating means such as flattened portions 70 spaced apart from each other as shown in FIGS. 1, 2 and 6. Flattened portions 70 are adapted to receive the finger tips of the user to prevent undesired rotation and to provide better control of the handle unit.

Figure 7:
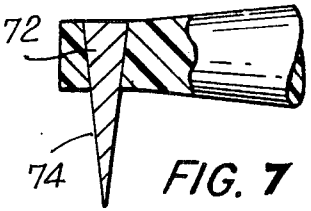
FIG. 7 is a diagrammatic sectional view of a portion of the handle with a toothpick retained in place in the handle.

As shown in FIG. 7, end portion 24 is provided with a transverse hole 72 adapted for receiving rigid or flexible inserts for cleaning between the teeth and gums. FIG. 7 shows how a toothpick 74 is fitted into and held by hole 72 with hole 72 being generally tapered so that the tapered end of a conventional toothpick can be forced into hole 72 and held in hole 72 with a firm friction fit. Alternatively, a conical-shaped flexible insert may be provided in hole 72 for use in cleaning between teeth and gums.

The embodiments shown in FIGS. 1–5 illustrate the best mode presently contemplated for practicing the invention. FIGS. 8–13 illustrate some of the representative alternative embodiments included within the scope of the appended claims.

Figure 8:
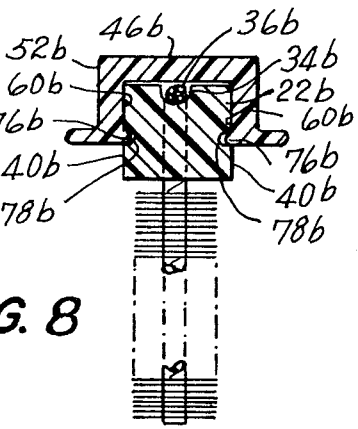

Referring to FIG. 8, section **52*b* of cap 46*b* has an inner surface 58*b* which is substantially rectangular in cross-sectional shape and includes opposed side surfaces 60*b*. End portion 22*b* has a cross-sectional shape closely corresponding to the cross-sectional shape of inner surface 58*b* and includes opposed side surfaces 40*b*. As shown in FIG. 8, opposed side surfaces 60*b* carry opposed ribs 76*b* extending inwardly for engagement with opposed recesses 78*b* carried by opposed end portion side surfaces 40*b*. Side surfaces 60*b* carrying ribs 76*b* are flexible enough so that ribs 76*b* are flexed outwardly during the initial communication between ribs 76*b* and opposed end portion side surfaces 40*b* but will relax inwardly to engage recesses 78*b*. In this way, opposed ribs 76*b* and recesses 78*b* cooperate to provide means to releasably attach section 52*b* to end portion 22*b* to securely retain stem 36*a* in groove 34*b*. A modification of the embodiment shown in FIG. 8 involves a handle in which the opposed end portion side surfaces 40*b* carry the ribs 76*b* which extend outwardly while the recesses 78*b* are carried by opposed side surfaces 60*b* of the inner surface 58*b* of section 52*b***.

Figure 9:
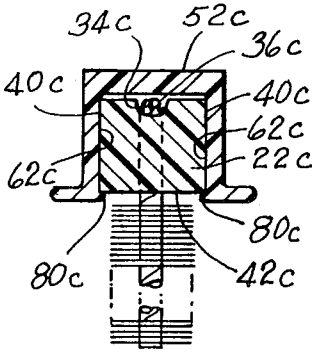
FIGS. 8 and 9 are diagrammatic sectional views similar to the views shown in FIGS. 4 and 5 but showing representative alternative embodiments of the invention.

The embodiment shown in FIG. 9 is similar to the embodiment shown in FIG. 8. However, ribs or projections **80*c* are carried at flexible opposed side edges 62*c* of inner surface 58*c* of section 52*c*. In this embodiment side edges 62*c* are flexed outwardly slightly while in communication with opposed end portion side surfaces 40*c* but relax inwardly for engagement with end portion bottom surface 42*c* to releasably attach section 52*c* to end portion 22*c* and secure stem 36*c* in groove 34*c***.

Figure 10:
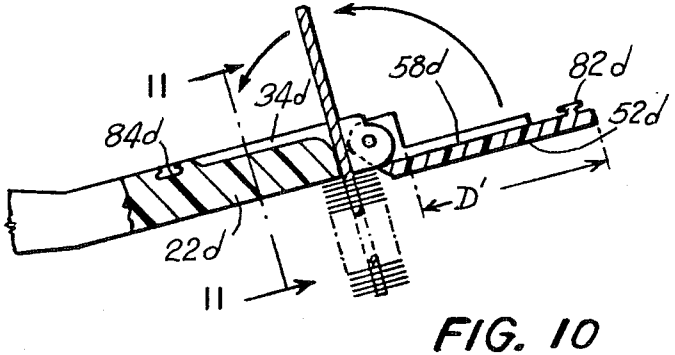
FIG. 10 is a diagrammatic sectional view similar to the view shown in FIG. 3 but showing another alternative embodiment of the invention.
Figure 11:
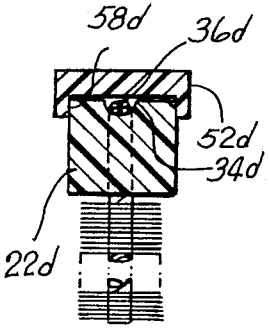
FIG. 11 is a diagrammatic sectional view taken at line 11—11 of FIG. 10 with the cap attached to the end section.

In the embodiment shown in FIGS. 10 and 11, the elements of a latch (a bar and cavity or recess) are used to releasably attach section **52*d* (D', FIG. 10) to end portion 22*d*. The illustrated latch elements include a bar 82*d* carried by inner surface 58*d* of section 52*d*. End portion 24*d* carries a notch or cavity 84*d* which is positioned beyond groove 34*d* and is shaped and sized to engage bar 82*d* to releasably attach section 52*d* to end portion 22*d* and securely retain stem 36*d* in groove 34*d*. Preferably, bar 82*d* is compressible so that it is compressed inwardly as it is inserted into cavity 84*d*** but relaxes outwardly after insertion.

Figure 12:
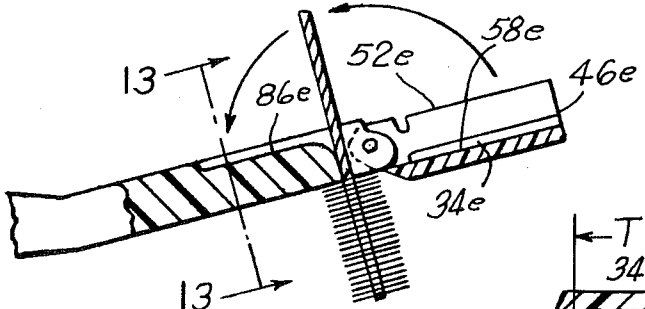
FIG. 12 is a diagrammatic sectional view similar to the views shown in FIGS. 3 and 11 but showing still another alternative embodiment of the invention.
Figure 13:
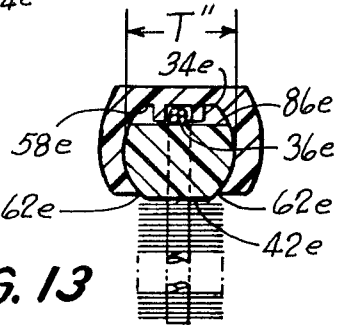
FIG. 13 is a diagrammatic sectional view taken at line 13—13 of FIG. 12 with the cap attached to the end section.

In the embodiment shown in FIGS. 12 and 13, groove **34*e* is carried by or formed in inner surface 58*e* of section 52*e*. Accordingly, as cap 46*e* is rotated downwardly toward end surface 22*e*, groove 34*e* can engage, capture and bend stem 36*e* downwardly to end portion top surface 86*e*. Opposed flexible side edges 62*e* are flexed outwardly as they are moved downwardly to approach and reach T' but relax inwardly as they approach and reach end portion bottom surface 42*e* to provide a snap action effect for releasably attaching section 52*e* to end portion 22*e* in the manner described in FIGS. 1–5**.

Various modifications and variations may be made in the described embodiments and such modifications and variations may be made without departing from the spirit and scope of the invention defined in the appended claims.

I claim:

1. An interproximal brush handle comprising:

(a) an elongated handle having a grip portion and an end portion including opposed side surfaces, a bottom surface and a transverse hole;

(b) a cap pivotally mounted to the end portion and including a section adapted and arranged for communication with the end portion to cover at least part of the end portion surface;

(c) a longitudinal groove carried by the end portion or the cap and adapted and arranged for communication with the transverse hole; and (d) means for releasably attaching the section to the end portion.

2. A handle of claim 1 where the end portion is bent upwardly at an angle of from about 5° to about 25° with respect to the longitudinal axis of the handle.

3. A handle of claim 1 where the groove is carried by the end portion.

4. A handle of claim 1 where the groove is carried by the cap.

5. A handle of claim 1 where the thickness of the end portion is less than the thickness of the grip portion.

6. A handle of claim 1 where the section comprises an opening having an inner surface which corresponds to the cross-sectional shape of the end portion and includes opposed side surfaces terminating at opposed side edges and the side surfaces are dimensioned to extend downwardly at least to the center of the end portion when the section is attached to the end portion.

7. A handle of claim 6 where the inner surface has a cross-sectional shape corresponding to the cross-sectional shape of the opposed end portion.

8. A handle of claim 7 where the inner surface is curved in shape.

9. A handle of claim 7 where the inner surface is cylindrical in shape.

10. A handle of claim 7 where the inner surface is rectangular in shape.

11. A handle of claim 6 where the means for releasably attaching the section to the end portion includes a section having an inner surface having opposed side surfaces terminating at opposed flexible side edges spaced apart from each other by a dimension which causes at least a portion of the edges to flex outwardly on engagement with opposed end portion side surfaces and the end portion has a cross-sectional shape whereby the flexible side edges can relax inwardly after flexing outwardly.

12. A handle of claim 11 where the end portion has a cross-sectional shape in which the thickness decreases toward the end portion bottom surface.

13. A handle of claim 1 where the means for releasably attaching the section to the end portion includes a bar adapted for latchable engagement with a recess.

14. A handle of claim 13 where the bar is carried by the cap.

15. A handle of claim 13 where the bar is carried by the end portion.

16. A handle of claim 1 where the section includes an opening having an inner surface including opposed side surfaces terminating at opposed side edges and the means for releasably attaching the section to the end portion includes ribs and recesses arranged and adapted for engagement with each other when the section is attached to the end portion.

17. A handle of claim 1 where the section includes an opening having an inner surface including opposed side surfaces terminating at opposed side edges and the means for releasably attaching the section to the end portion includes projections arranged at the opposed side edges extending toward each other and adapted for engagement with the end portion bottom surface.

18. A handle of claim 1 including an interproximal brush having a stem which is inserted through the hole and retained in the groove.

19. A handle of claim 1 including a second end portion having a tapered transverse hole to retain a rigid or flexible insert for cleaning between teeth or gums.

20. A handle of claim 19 where the insert is rigid.

21. An interproximal brush handle comprising (a) an elongated handle having a grip portion and an end portion including opposed side surfaces, a bottom surface, a transverse hole and a longitudinal groove adapted and arranged for communication with the transverse hole;

(b) a cap pivotally mounted to the end portion and including a section adapted and arranged for communication with the end portion, said section including an inner surface including opposed side surfaces terminating at opposed side edges and said inner surface having a cross-sectional shape corresponding to the cross-sectional shape of the opposed end portion; and (c) means for releasably attaching the section to the end portion.

22. A handle of claim 21 where the end portion is bent upwardly at an angle of from about 5° to about 25° with respect to the longitudinal axis of the handle.

23. A handle of claim 21 where the means for releasably attaching the section to the end portion includes a section having flexible opposed side edges spaced apart from each other by a dimension which causes at least a portion of the edges to flex outwardly on engagement with opposed end portion side surfaces and the end portion has a cross-sectional shape whereby the flexible side edges can relax inwardly after flexing outwardly.

24. A handle of claim 23 where the end portion has a cross-sectional shape in which the thickness decreases toward the end portion bottom surface.

25. A handle of claim 21 including an interproximal brush having a stem which is inserted through the hole and retained in the groove.

* * * * *

UNITED STATES PATENT AND TRADEMARK OFFICE

CERTIFICATE OF CORRECTION

PATENT NO. : 4,780,923

DATED : November 1, 1988

INVENTOR(S) : Peter Schultheiss

It is certified that error appears in the above-identified patent and that said Letters Patent is hereby corrected as shown below:

Column 4, line 19, change "24" to --22--.

Column 4, line 34, change "24" to --22--.

Column 4, line 35, change "24" to --22--.

Column 4, line 37, change "24" to --22--.

Column 4, line 39, change "24" to --22--.

Column 6, line 10, change "36a" to --36b--.

Column 6, line 31, change "24d" to --22d--.

Signed and Sealed this

Sixth Day of June, 1989

*Attest:*

*Attesting Officer*

DONALD J. QUIGG

*Commissioner of Patents and Trademarks*